US005933909A

United States Patent [19]

Keating

[11] Patent Number: 5,933,909

[45] Date of Patent: Aug. 10, 1999

[54] SKIN SCRUBBING APPARATUS

[76] Inventor: Catherine A. Keating, 370 Central Park West, Apt. 211, New York, N.Y. 10025

[21] Appl. No.: 09/010,455

[22] Filed: Jan. 21, 1998

[51] Int. Cl.[6] ..... A47K 7/02

[52] U.S. Cl. ..... 15/244.1; 4/606; 601/136

[58] Field of Search ..... 15/104.92, 210.1, 15/244.1, 244.3, 244.4; 4/606; 601/136

[56] References Cited

U.S. PATENT DOCUMENTS

| | | | |
|---|---|---|---|
| 1,954,940 | 4/1934 | Mikel | 601/136 X |
| 2,904,038 | 9/1959 | Hackney | 15/244.1 X |
| 3,036,081 | 11/1962 | Brown | 15/244.1 X |
| 3,289,215 | 12/1966 | Kennedy | 4/606 |
| 3,750,226 | 8/1973 | Morgan | 15/244.1 X |
| 4,053,960 | 10/1977 | Kingswell | 15/104.92 |
| 4,417,362 | 11/1983 | Walker | 4/606 |
| 4,890,352 | 1/1990 | Stowers et al. | 15/244.1 |
| 5,277,389 | 1/1994 | Ballares et al. | 4/606 X |
| 5,600,864 | 2/1997 | Huber | 15/244.1 X |
| 5,724,695 | 3/1998 | Galizia | 15/104.92 X |

FOREIGN PATENT DOCUMENTS

| | | | |
|---|---|---|---|
| 2216000 | 10/1989 | United Kingdom | 15/210.1 |
| 2253142 | 9/1992 | United Kingdom | 15/244.1 |
| 2278052 | 11/1994 | United Kingdom | 15/244.1 |

*Primary Examiner*—Mark Spisich
*Attorney, Agent, or Firm*—Graham & James LLP

[57] ABSTRACT

A skin treating apparatus includes a sponge such as a loofah sponge which is secured to a support member. The support member is connected to an attaching unit which includes a plurality of suction members for releasably attaching the skin treating apparatus to a floor or wall surface of a bathtub or shower. The skin treating apparatus can be used without requiring the user to hold the skin treating apparatus and the skin treating apparatus can be moved to any desired location on a wall or floor surface within a bathtub or shower.

9 Claims, 3 Drawing Sheets

SKIN SCRUBBING APPARATUS

BACKGROUND OF THE INVENTION

1. Field of the Invention

The present invention relates to a scrubbing apparatus for use on human skin, and more particularly, to an improved loofah sponge mounted on an attaching member which is adapted to be releasably attached to a wall or floor surface.

2. Description of the Related Art

In recent years, the increasing focus on human hygiene, especially the skin, has produced many skin treating devices. One such device is a loofah sponge which is used to scrub the skin to remove dead skin and revitalize the skin. Known loofah sponges include the standard loofah sponge which does not include any type of supporting or mounting structure whatsoever. The sponge is simply gripped by the user and moved along the surface of the skin to provide a desired skin treatment.

Other devices include a loofah sponge mounted on an elongated handle to allow a user to use the loofah on the back of the user or on the lower extremities, including hands, the back and the feet, especially the bottom of the feet.

In addition, another device includes a loofah sponge having two flexible elongated handle members, usually in the form of resilient fabric material, for allowing the user to grip the resilient handles at either end and move the loofah sponge back and forth along the lower extremities, the bottom of the feet and the back of the user. However, the use of such conventional loofah devices requires that the user move the loofah or a handle holding the loofah back and forth along the surface of the user's back, feet, hands or other parts of the body. This requires the user to move in an awkward motion and makes it extremely difficult for a user to easily and completely treat all of the skin surface of the user's back and other areas of the body. More specifically, when the user is attempting to treat the surface on the lower extremities, especially the bottom of the user's foot, the user must raise one foot and stand on one leg while attempting to scrub the bottom of the foot while balancing on one leg and either with one hand or no hands, depending on the number of handles on the loofah device. This often leads to many accidents such as slipping and falling in the shower/tub. If the loofah device has two resilient cloth handles as described above, the user would have to stand on one leg and could not support themselves with their hands because their hands would be gripping the two handles to move the loofah device along the bottom surface of the foot.

SUMMARY OF THE INVENTION

To overcome the problems discussed above, the preferred embodiments of the present invention provide an improved skin treating apparatus in which the apparatus is adapted to be releasably secured to a surface such that the user does not have to hold the skin treating apparatus during use.

The preferred embodiments of the present invention also provide an improved skin treating apparatus which can be reliably and releasably secured to a surface, such as a shower or bath tub floor or wall, such that the user does not have to grip the skin treating apparatus during use, and the user can simply move the skin surface which is intended to be treated relative to and along the surface of the skin treating apparatus. This allows the user to support themselves with at least three of the four lower extremities (arms and legs) while easily treating all areas of the skin on a body, including tough to reach areas of the user's body.

In a first preferred embodiment, the improved skin treating apparatus includes a skin treating sponge unit and an attaching member which is connected to the sponge unit and is adapted to be releasably fixed to a support surface such as the floor or wall of a shower or bath tub.

In this first preferred embodiment, the sponge unit preferably is a loofah sponge and the attaching member preferably comprises a rubber mat including a plurality of suction members, preferably in the form of suction cups which are adapted and arranged to be adhered and releasably fixed to a surface such as a tub or shower floor or wall. The number and arrangement of the suction members should be sufficient to ensure that the improved skin treating apparatus can be securely mounted on a wall or floor of a surface such as a tub or shower such that the improved skin treating apparatus is not moved or detached from the surface during use. The loofah sponge unit and the attaching member are joined to each other via a suitable adhesive such as rubber cement or very high strength adhesive which are commercially available for joining rubber and non-rubber materials together.

In another preferred embodiment, instead of the sponge unit being joined directly to the attaching member, a support member is provided and disposed between the sponge unit and the attaching member to increase the rigidity of the apparatus and to more securely mount the sponge unit to the attaching member. In this preferred embodiment, both the sponge unit and the attaching member are attached to the support member via a suitable adhesive as described above. The support member is preferably made of plastic, wood or other suitable materials such as a thermoplastic resin.

In another preferred embodiment, a mounting member is provided on the attaching member and is adapted to removably receive the support member. The mounting member is preferably a substantially U-shaped member which is adapted to receive the support member. The support member preferably comprises a plate-shaped member which is adapted to slide into the U-shaped recess in the mounting member. In this manner, the support member and attached sponge unit can be removably inserted into the U-shaped recess of the mounting member for use and then removed from the U-shaped recess of the mounting member. The U-shaped mounting member is joined to the attaching member via a suitable high strength adhesive as described above. Thus, the U-shaped mounting member and attaching member can remain fixed to a surface of a shower or bath tub without having to remove it therefrom when it is necessary to replace a sponge unit. Instead, the support member and attached sponge unit can be slid out of the U-shaped recess in the mounting member and a new support member and sponge unit can be inserted therein.

In another preferred embodiment, the attaching member is connected to the support member as described above. However, a clamp bar is inserted through the sponge unit and is clamped to the support member via suitable clamping members located preferably at both ends of the clamp bar. The clamping members may comprise a combination screw and locking nut, a spring-loaded clamp or other suitable clamping mechanisms. The clamping members are movable from a clamped position to an unclamped position so as to allow the clamp bar and sponge unit to be removed from the attaching member and support member. Once the clamping members have been moved into the clamped position, the loofah can be used without movement and while being securely clamped to the support member and attaching member via the clamp bar and also securely attached to the surface of the shower or tub via the attaching member. When the sponge unit must be replaced, the clamping members can simply be moved into the unclamped position and the clamp bar and sponge unit removed from the attaching member and support member. The clamp bar can then be removed from the worn sponge unit and a new sponge unit can be inserted on the clamp bar. The clamp bar can then be moved back into position on the support member and aligned with the clamping members so that the clamping members can be moved into the clamped position to secure the new sponge unit onto the support member and attaching member. It should be noted that the clamping members may comprise a structure which is integral with the support member and possibly the attaching member or may comprise a structure which is partially or completely separate therefrom.

With the improved skin treating apparatus described above, the user can releasably position and secure the apparatus to any desired location on the floor or walls of a shower or bathtub so that the user can treat any desired surface of the skin without having to hold the skin treating apparatus. This allows the user to support themselves with both hands and at least one foot. That is, if the user is treating a lower extremity such as the bottom surface of one foot, the user can support themselves with both hands and the other foot. If the user desires to treat the surface of the back, the improved skin treating apparatus can be fixedly mounted on the wall and the user can support themselves with both arms and stand on both legs. Because the user does not have to attempt the awkward stretching movement back and forth for treating the surface of the back as is required in the conventional devices, the user can easily and completely treat all surfaces of the back and any other surface of the skin.

These and other elements, feature and advantages of the preferred embodiments of the present invention will be apparent form the following detailed description of the preferred embodiments of the present invention, as illustrated in the accompanying drawings.

BRIEF DESCRIPTION OF THE DRAWINGS

The accompanying drawings, which are included to provide a further understanding of the invention and are incorporated in and constitute a part of this application, illustrate the preferred embodiments of the invention and together with the description, serve to explain the principles of the invention, in which.

DETAILED DESCRIPTION OF PREFERRED EMBODIMENTS

Figure 1A:
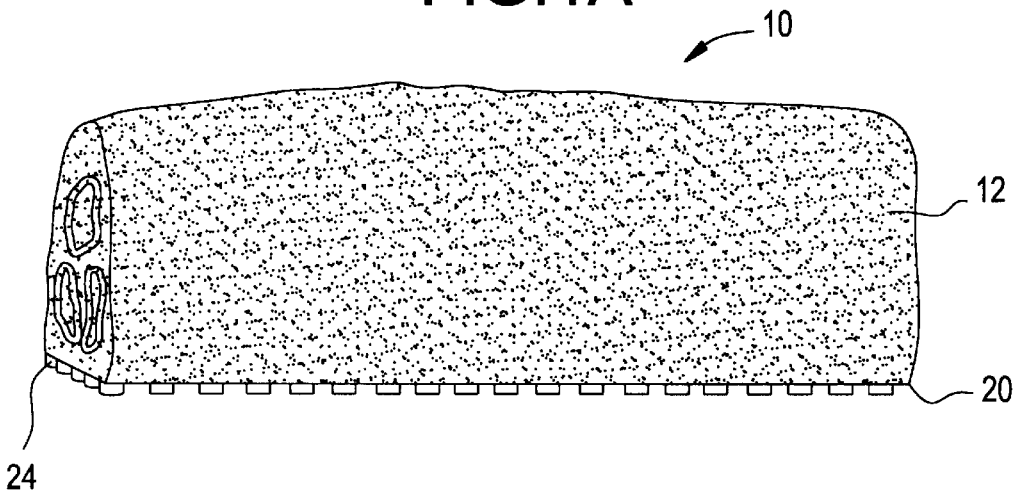
FIG. 1A is a detail isometric view of a first preferred embodiment of the improved skin treating apparatus of the present invention.

Reference will now be made in detail to preferred embodiments of the present invention, examples of which are illustrated in the accompanying drawings, in which like reference numerals indicate like elements.

Figure 1B:
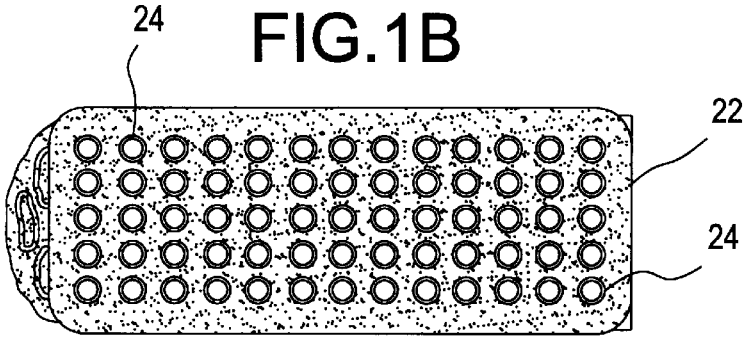
FIG. 1B is a bottom view of the improved skin treating apparatus shown in FIG. 1A.

FIGS. 1A and 1B show a first preferred embodiment of the present invention, in which a skin treating apparatus 10 includes a skin treating or scrubbing member 12 such as a sponge, preferably a loofah sponge. The sponge 12 is attached to an attaching member 20 as seen in FIG. 1A via a suitable adhesive such as rubber adhesive or super strength adhesive conventionally available.

The attaching member 20 is preferably constructed to be releasably fixed to a support surface such as the floor or wall of a shower or bath tub. More specifically, the attaching member 20 preferably includes a rubber mat 22 having a relatively flat surface and a plurality of suction members 24, preferably in the form of suction cups which are adapted and arranged to be adhered and releasably fixed to a surface such as a tub or shower floor or wall.

When the attaching member 20 is to be attached to a surface, the apparatus 10 is arranged such that the rubber mat 22 is substantially parallel to the surface upon which the apparatus is to be mounted. Pressure is applied to the apparatus 10 such that the suction cup members 24 are firmly adhered to the surface so as to attach the apparatus 10 to the surface for use of the skin treating member 12. The skin scrubbing apparatus 10 remains stationary until sufficient pressure is applied so as to pull the suction members 24 away from the surface and remove the attaching member 20 from the surface.

While stationary, a user can easily move a plurality of skin surfaces and body parts against the skin scrubbing member 12 while supporting and balancing themselves using at least three lower extremities (arms and legs). Because of the attaching member 20, the scrubbing apparatus 10 does not move during use. The number and arrangement of the suction members 24 should be sufficient to ensure that the improved skin treating apparatus can be securely mounted on a wall or floor of a surface such as a tub or shower such that the improved skin treating apparatus is not moved or detached from the surface during use.

Thus, with the removably securable construction and features of the apparatus 10 shown in FIGS. 1A and 1B, a user can releasably position and secure the apparatus 10 to any desired location on the floor or walls of a shower or bathtub so that the user can treat any desired surface of the skin without having to hold the skin treating apparatus 10. This allows the user to support themselves with both hands and at least one foot. That is, if the user is treating a lower extremity such as the bottom surface of one foot, the user can support themselves with both hands and the other foot. If the user desires to treat the surface of the back, the improved skin treating apparatus can be fixedly mounted on the wall and the user can support themselves with both arms and stand on both legs. Because the user does not have to attempt the awkward stretching movement back and forth for treating the surface of the back as is required in the conventional devices, the user can easily and completely treat all surfaces of the back and any other surface of the skin.

Figure 2:
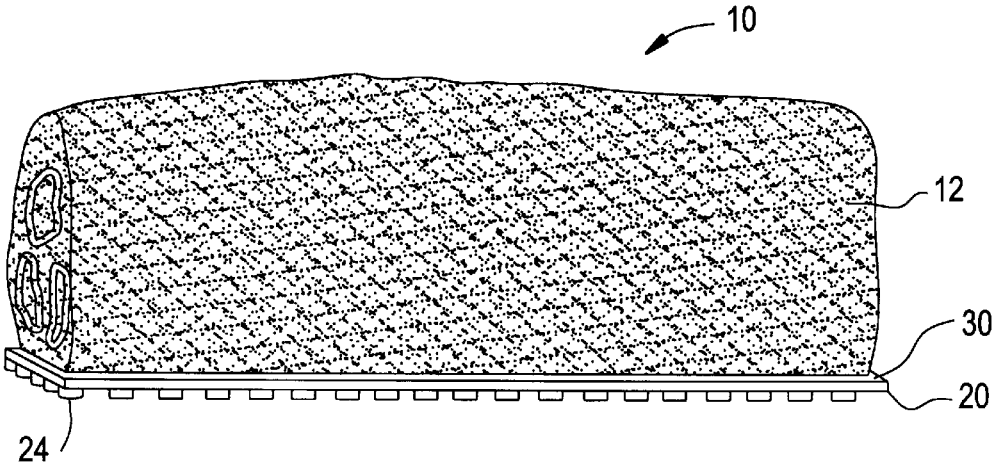
FIG. 2 is an isometric view of a second preferred embodiment of the improved skin treating apparatus of the present invention.

Another preferred embodiment of the present invention is shown in FIG. 2. The preferred embodiment shown in FIG. 2 is similar to the preferred embodiment shown in FIGS. 1A and 1B except that a support member 30 is provided for supporting the skin treating apparatus 10 and providing a more stable apparatus should more stringent skin treating and scrubbing be desired.

The support member 30 may be preferably made of wood, plastic, metal or the suitable material. The support member 30 is preferably joined to the attaching member 20 and the sponge member 12 via a suitable adhesive described above.

The preferred embodiment shown in FIG. 2 provides the same advantages described above with reference to the preferred embodiment shown in FIGS. 1A and 1B while also providing a more sturdy apparatus 10.

Figure 3A:
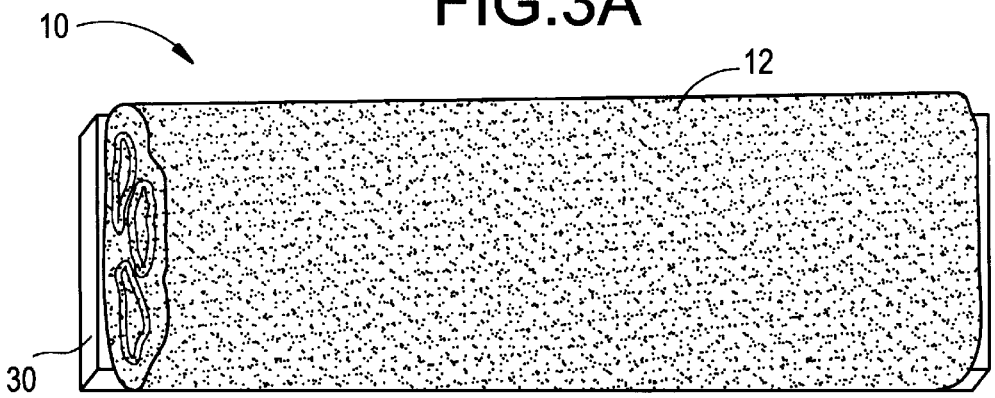
FIG. 3A is a top isometric view of a first component of a third preferred embodiment of the improved skin treating apparatus of the present invention.
Figure 3B:
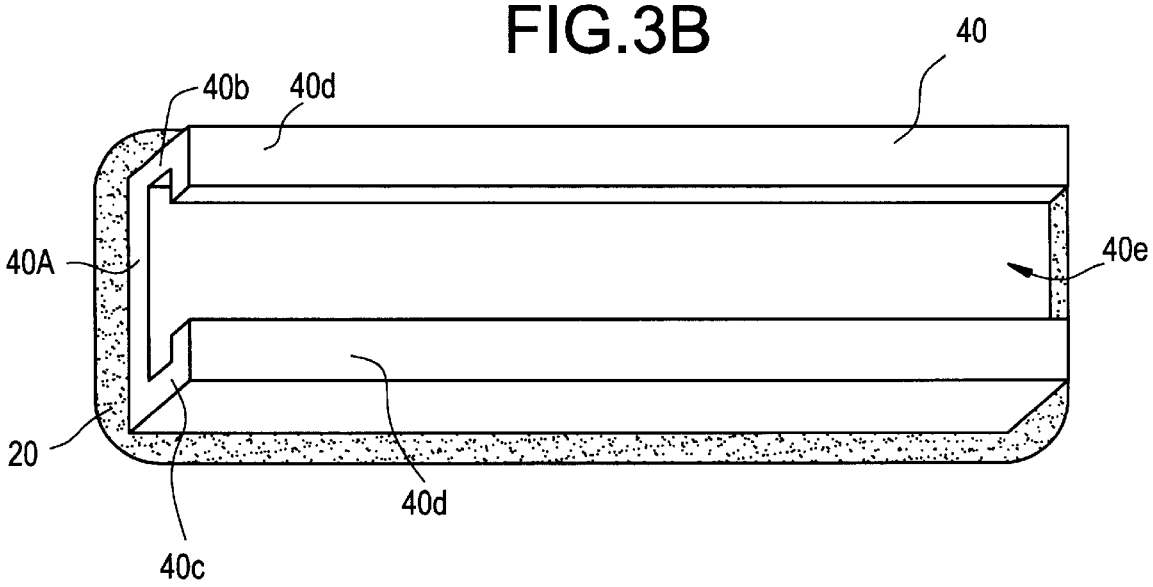
FIG. 3B is a top isometric view of a second component of a third preferred embodiment of the improved skin treating apparatus of the present invention.
Figure 3C:
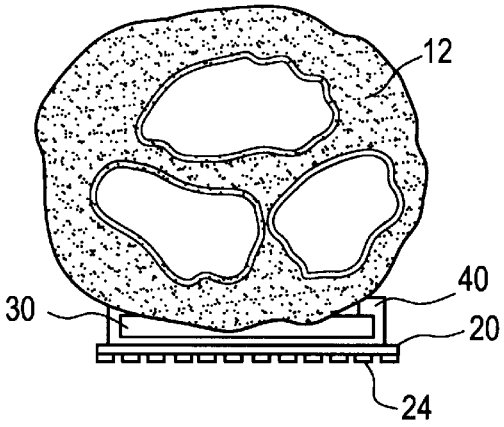
FIG. 3C is a side view of the first and second components of FIGS. 3A and 3B in an assembled state.

A third preferred embodiment is shown in FIGS. 3A–3C. The preferred embodiment shown in FIGS. 3A–3C comprises a two part structure which is removably attached to each other. More specifically, the first component shown in FIG. 3A preferably includes the sponge member 12 and the support member 30 described above with reference to FIG. 2. The support member 30 preferably comprises a substantially rectangular plate type member made of a suitable material as described above.

A second component is shown in FIG. 3B. The second component preferably comprises a substantially U-shaped mounting member 40 which has a base or bottom wall 40*a*, side walls 40*b*, 40*c* and top rim portions 40*d* which form a substantially U-shaped cavity 40*e*. The mounting member 40 is fixed to the attaching member 20 via the suitable adhesive described above with reference to the other preferred embodiments.

As is seen in FIG. 3C, the support member 30 and mounting member 40 are adapted to be engaged with each other so as to mount the support member 30 and attached sponge member 12 in the stationary attaching member 20 and attached mounting member 40. In this manner, the support member 30 and attached sponge unit 12 can be removably inserted into the U-shaped recess 40*e* of the mounting member 40 for use and then removed from the U-shaped recess 40*e* of the mounting member 40. The substantially U-shaped mounting member 40 is joined to the attaching member 20 via a suitable high strength adhesive as described above. Thus, the U-shaped mounting member 40 and attaching member 20 can remain fixed to a surface of a shower or bath tub without having to remove it therefrom when it is necessary to replace a sponge unit 12. Instead, the support member 30 and attached sponge unit 12 can be slid out of the U-shaped recess 40*e* in the mounting member and a new support member 30 and sponge unit 12 can be inserted therein.

Figure 4:
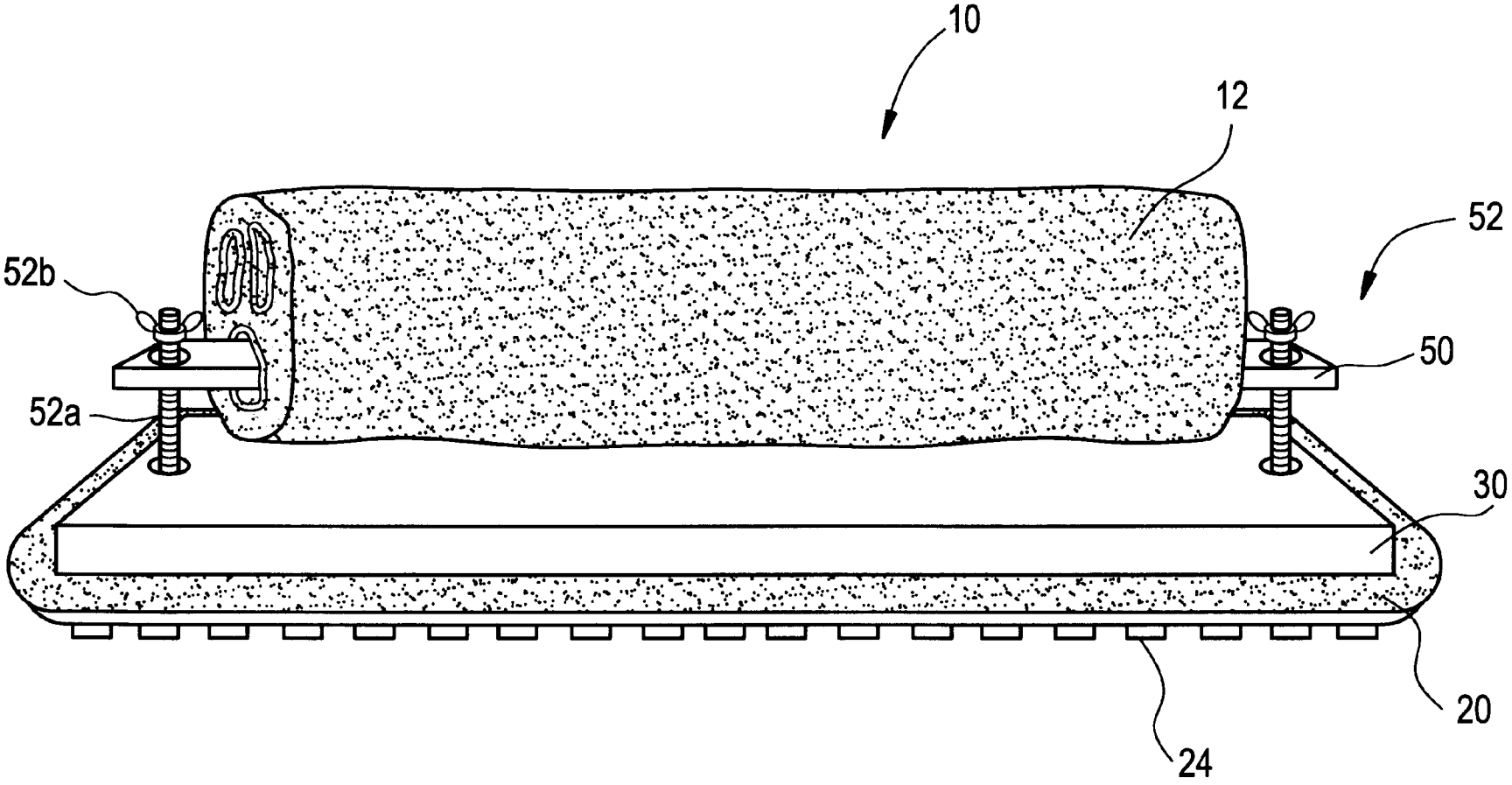
FIG. 4 is an isometric detail view of a fourth preferred embodiment of the improved skin treating apparatus of the present invention.

In another preferred embodiment shown in FIG. 4, the attaching member 20 is connected to the support member 30 as described above. However, a clamp bar 50 is inserted through the sponge unit 12 and is clamped to the support member via one or more clamping members 52.

The clamping members 52 are preferably located at either end of the apparatus 10 at locations corresponding to opposite ends of the clamp bar 50. The clamping members 52 may comprise a combination screw 52*a* and locking nut 52*b* as shown in FIG. 4. As can be seen in FIG. 4, the screw 52*a* is preferably integrally provided in the support member 30 and may also be connected to or integral with the attaching member 20.

In the preferred embodiment shown in FIG. 4, the support member 30 preferably includes openings suitably located for allowing the screws 52*a* to protrude therethrough. In addition, the clamp bar 50 also preferably includes holes or openings for allowing the upper portion of the screws 52*a* to project therethrough. As a result, the clamping bar 50 can be reliably and securely positioned on the support member 30 via the clamping members 52 including the screws 52*a* and engaging nuts 52*b*.

As can be seen in FIG. 4, once the clamping bar 50 is engaged on the screws 52*a*, the nuts can be threadedly tightened to an extent or position wherein the clamp bar 50 presses the lower surface of the sponge unit 12 on the support member 30 thereby securing the sponge unit 12 on the attaching member 20 and support member 30.

Thus, the sponge unit 12 can be easily removed from the attaching member 20 and support member 30 by simply loosening the nuts 52*b*, removing the clamp bar 50 from the screws 52*a*, removing the clamp bar 50 from the sponge unit 12. Then, a new sponge unit 12 can be slid onto the clamp bar 50 and the clamp bar 50 can be positioned on the screws 52*a* and secured to the attaching member 20 and support member 30 via nuts 52*b*.

Alternatively, the clamping members may comprise a spring-loaded clamp or other suitable clamping mechanisms. The clamping members should be movable from a clamped position to an unclamped position so as to allow the clamp bar 50 and sponge unit 12 to be removed from the attaching member 20 and support member 30. Once the clamping members 52 have been moved into the clamped position, the loofah sponge unit 12 can be used without movement and while being securely clamped to the support member 30 and attaching member 20 via the clamp bar 50 and also securely attached to the surface of the shower or tub via the attaching member 20. When the sponge unit 12 must be replaced, the clamping members 52 can simply be moved into the unclamped position and the clamp bar 50 and sponge unit 12 removed from the attaching member 20 and support member 30. The sponge unit 12 can then be replaced as described above.

With the improved skin treating apparatus described above, the user can releasably position and secure the apparatus to any desired location on the floor or walls of a shower or bathtub so that the user can treat any desired surface of the skin without having to hold the skin treating apparatus. In addition, the sponge unit can be easily and quickly replaced and then reliably secured back onto the attaching member for use. Thus, the skin scrubbing apparatus of the preferred embodiments of the present invention can be located at any desired position and also eliminates the need to support oneself during use while gripping the skin scrubbing apparatus.

While the invention has been particularly shown and described with reference to preferred embodiments thereof, it will be understood by those skilled in the art that the foregoing other changes in form and details my be made therein without departing from the spirit and scope of the invention.

What is claimed is:

1. A skin treating apparatus comprising:

a support member;

a sponge member;

an attaching member connected to the support member and adapted to be releasably secured to a wall surface or floor surface of a shower or bathtub;

a clamp bar for securing the sponge member to the support member; and at least one clamping member for clamping the clamp bar to the support member.

2. A skin treating apparatus according to claim 1, wherein the support member is connected to the sponge member and to the attaching member for supporting the sponge member on the attaching member.

3. A skin treating apparatus according to claim 2, wherein the support member is formed of wood or plastic.

4. A skin treating apparatus according to claim 1, wherein the sponge member comprises a loofah sponge.

5. A skin treating apparatus according to claim 1, wherein the attaching member comprises a plurality of suction members arranged and adapted to be releasably secured to the wall surface or the floor surface.

6. A skin treating apparatus according to claim 1, wherein the clamp bar extends through the sponge member and is operatively connected to the clamping member.

7. A skin treating apparatus according to claim 6, wherein the clamp bar includes openings for receiving a portion of the clamping member.

8. A skin treating apparatus according to claim 1, wherein the at least one clamping member comprises at least one screw and at least one nut engaging the screw.

9. A skin treating apparatus according to claim 8, wherein the clamp bar and the support member include openings for receiving different portions of the screw therein.

* * * * *